United States Patent [19]

Fleming

[11] Patent Number: 4,480,862

[45] Date of Patent: Nov. 6, 1984

[54] LATCHING AND LOCKING MECHANISM FOR SLIDING DOOR

[75] Inventor: Paul D. Fleming, Glendale, Calif.

[73] Assignees: W & F Manufacturing, Inc., Glendale, Calif.; Peachtree Doors, Inc., Norcross, Ga.

[21] Appl. No.: 325,238

[22] Filed: Nov. 27, 1981

[51] Int. Cl.[3] ..... E05C 1/10

[52] U.S. Cl. ..... 292/162; 292/DIG. 46; 292/150; 292/244

[58] Field of Search ..... 292/162, 244, 170, 183, 292/189, 179, 150, 101, 106, 130, 136, 175, DIG. 46, 127

[56] References Cited

U.S. PATENT DOCUMENTS

| | | | |
|---|---|---|---|
| 830,361 | 9/1906 | Peck et al. | 292/136 |
| 1,487,522 | 3/1924 | Andrews | 292/175 |
| 1,625,145 | 4/1927 | O'Connor | 292/183 X |
| 1,972,201 | 9/1934 | Preston | 292/189 |
| 2,087,829 | 7/1937 | Wraae | 292/175 X |
| 2,545,645 | 3/1951 | Blakely | 292/127 |
| 2,627,433 | 2/1953 | Wolfe | 292/106 X |
| 2,673,109 | 3/1964 | Frost . | |
| 2,727,773 | 12/1955 | Hagstrom . | |
| 2,760,804 | 8/1956 | Falk . | |
| 2,764,014 | 9/1956 | George . | |
| 2,978,267 | 4/1961 | North et al. . | |
| 3,827,738 | 8/1974 | Dushane, Jr. | 292/106 X |

*Primary Examiner*—Richard E. Moore

*Attorney, Agent, or Firm*—Fulwider, Patton, Rieber, Lee & Utecht

[57] ABSTRACT

A latching and locking mechanism for sliding doors such as patio screen doors and the like, wherein a latch hook engaging a keeper may be unlatched by operating either an inside or an outside slide member, and the latch hook may be locked by a locking mechanism operable only from the inside of the sliding door. The latching and locking mechanism is lengthwise functionally symmetric so that it may be utilized either in doors opening from left to right or doors opening from right to left. The locking function is performed by a locking bolt which is cammed into position by an angularly disposed cam slot of a bolt actuator.

18 Claims, 11 Drawing Figures

Fig. 8
DOOR LATCHED
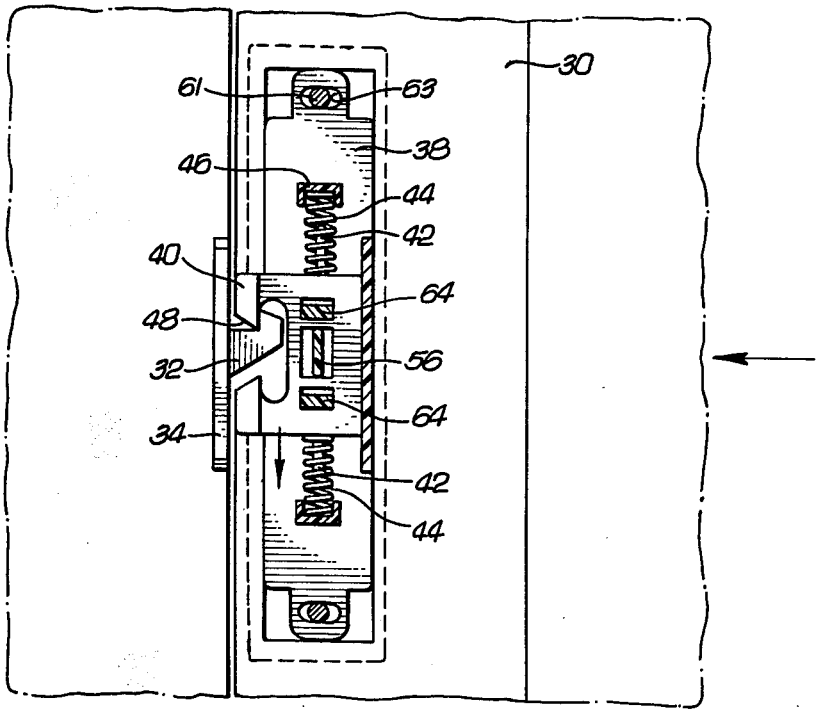
Fig. 9
DOOR UNLATCHED
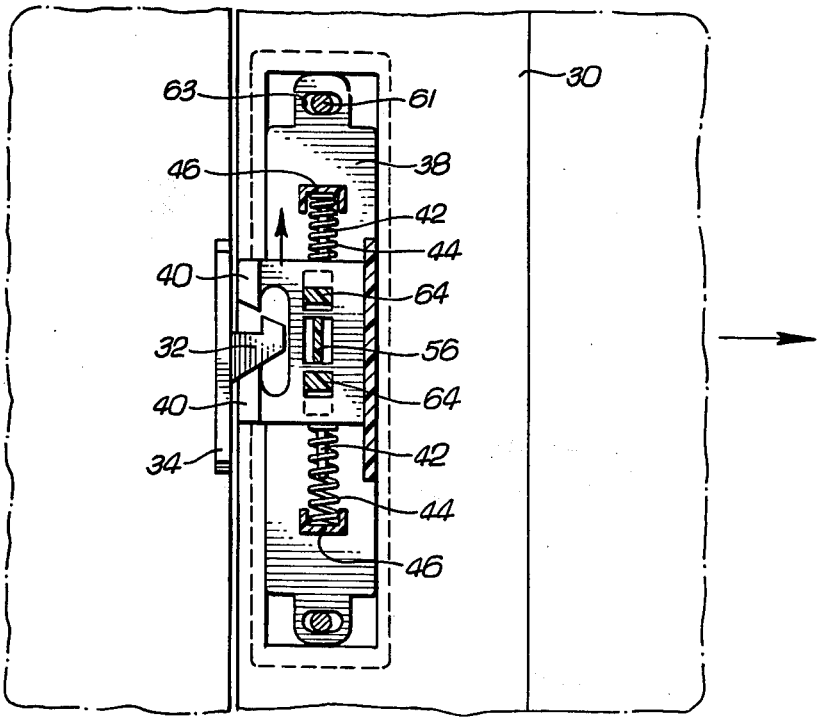
Fig. 10
LATCH UNLOCKED
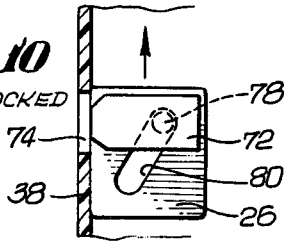
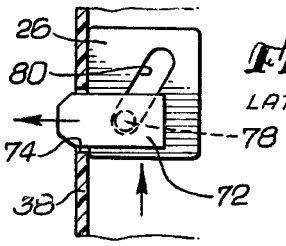
Fig. 11
LATCH LOCKED

LATCHING AND LOCKING MECHANISM FOR SLIDING DOOR

BACKGROUND OF THE INVENTION

This invention relates generally to latching and locking mechanisms, and more particularly, to a latching and locking mechanism for sliding doors wherein the latch is activated by slide members and has an integral bolt locking mechanism.

Sliding doors are typically used in homes and other locations where there is insufficient space for a swinging door mounted on hinges, or the use of a sliding door is aesthetically pleasing. As an example, sliding screen doors and sliding glass doors have found wide application in homes as entryways from patio areas.

For those sliding doors providing access to a building, a necessary part of the hardware of the door is a latching and locking mechanism whereby the sliding door may be latched closed, unlatched from either the inside or the outside of the building, and securely locked from the inside only if desired. Since sliding doors are often used in portions of the building involving recreational activities, such as patio access screen doors, it is highly desirable that the latching and locking mechanism be located entirely below or flush with the planar surfaces of the door, to enhance the appearance and avoid accidents resulting from projecting parts.

From an economic standpoint, the latching and locking mechanism should be economically manufactured and reliable, with design safeguards which avoid the possibility of breakage of the mechanism during normal usage. It is further desirable that a single latching and locking mechanism be usable for sliding doors which open from left to right and doors which open from right to left, since this approach reduces manufacturing and inventory costs, and simplifies the considerations of installation.

Prior devices for accomplishing the latching and locking function on sliding screen doors have utilized a pivoted latching lever, having a latch at one end, a central pivot and a lever operable by the person opening the door. As an example of its use, the latch may be pivoted upwardly to clear a keeper located in the door jamb by pressing the lever downwardly and then sliding the door open. Any excessive forces exerted by the person opening the door are carried by the pivoting mechanism or are reacted against the edges of the slot through which the handle protrudes. Since it is not uncommon that excessive forces are exerted and because the materials of construction of such latching and locking mechanisms are typically low cost plastics, such lever-actuated latching and locking devices commonly fail in use by failure of the lever component. It is therefore desirable to devise a latching and locking mechanism wherein excessive opening forces are not transmitted to inherently low-strength portions of the structure, but are instead absorbed and reacted against comparatively strong portions of the structure.

Accordingly, there has been a need for a latching and locking mechanism for sliding doors that securely latches the door closed but may be unlatched from either the inside or the outside of the door, may be securely locked in the closed position only from the inside of the door, may be used with doors opening from right to left or left to right with a single device, may be economically manufactured, lies flush with the surface of the door, and whose design inherently avoids the transmittal of excessive opening forces to comparatively weak portions of the mechanism. The present invention fulfills this need, and further provides related advantages.

SUMMARY OF THE INVENTION

The present invention provides a mechanism for latching and locking a sliding door, wherein unlatching of a latch member is accomplished by outside and inside slide members, and a locking bolt is provided on the inside slide member to lock the latching mechanism securely. The portion of the mechanism installed in the sliding door is functionally symmetric from top to bottom, allowing the latching and locking mechanism to be used in conjunction with doors opening from left to right and doors opening from right to left by simply inverting the portion of the mechanism installed in the sliding door and fixing the keeper to the opposite door jamb. Additionally, the latching and locking mechanism is inexpensive to construct, lies flush with the surfaces of the door, and reacts any excessive opening forces against substantial portions of structure rather than inherently weak elements. With this invention, sliding doors may be readily latched and locked using an economical, reliable mechanism.

In accordance with the invention, the latch member having symmetrical opposing latch hooks for engaging a catch on a keeper fastened to the door jamb is mounted in a two-piece housing by pins and springs which bias the latch member to a lengthwise central position in the housing. The outside and inside slide members extend through the respective portions of the housing to engage slots in the latch member, so that operation of either slide member translates the latch member upwardly to clear the catch on the keeper, allowing the door to be opened while the latch member is in the translated position. A locking bolt having a cam pin engaging an angularly disposed cam slot of a bolt actuator is mounted on the inside slide member, so that manual actuation of the bolt actuator by a person on the inside of the door extends the locking bolt by the cam action to engage a bolt opening on the inside portion of the housing, thereby locking the latch member at its central location so that it may not be translated to clear the catch by either the outside or the inside slide member. The housing, the latch member and the slide members are dimensioned so that excessive opening forces are transmitted to relatively strong portions of the housing to reduce the likelihood of failure of the latching and locking mechanism through the application of excessive opening force.

It will be appreciated from the foregoing that the present invention represents an advance in latching and locking mechanisms for use with sliding doors, such as screen doors in a home. With this mechanism, sliding doors may be latched and locked, and later unlocked and opened by operation of the outside or inside slide member. The portions of the mechanism installed in the sliding door are functionally symmetric from top to bottom and may be used in doors opening from left to right or doors opening from right to left without structural modification, by simply inverting the mechanism. The portion of the mechanism installed in the door lies substantially flush with the surfaces of the door, yet allows convenient operation of the slide members for opening the door. The mechanism is economical to manufacture and resists damage from application of excessive opening force during use.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate a presently preferred embodiment of the invention. In such drawings:

FIG. 8 is an enlarged sectional elevational view of the latching and locking mechanism in the latched position, as viewed from the inside of the door in FIG. 1;

FIG. 9 is an enlarged sectional elevational view of the latching and locking mechansim in the unlatched position, as viewed from the inside of the door in FIG.1;

FIG. 10 is an enlarged sectional elevational view illustrating the cooperation of a cam pin on the locking bolt and the angularly disposed cam slot of the bolt actuator, with the latch in the unlocked position and;

FIG. 11 is an enlarged sectional elevational view illustrating the cooperation of the cam pin on the locking bolt and the angularly disposed cam slot of the bolt actuator, with the latch in the locked position.

DETAILED DESCRIPTION OF THE PREFERRED EMBODIMENT

Figure 1:
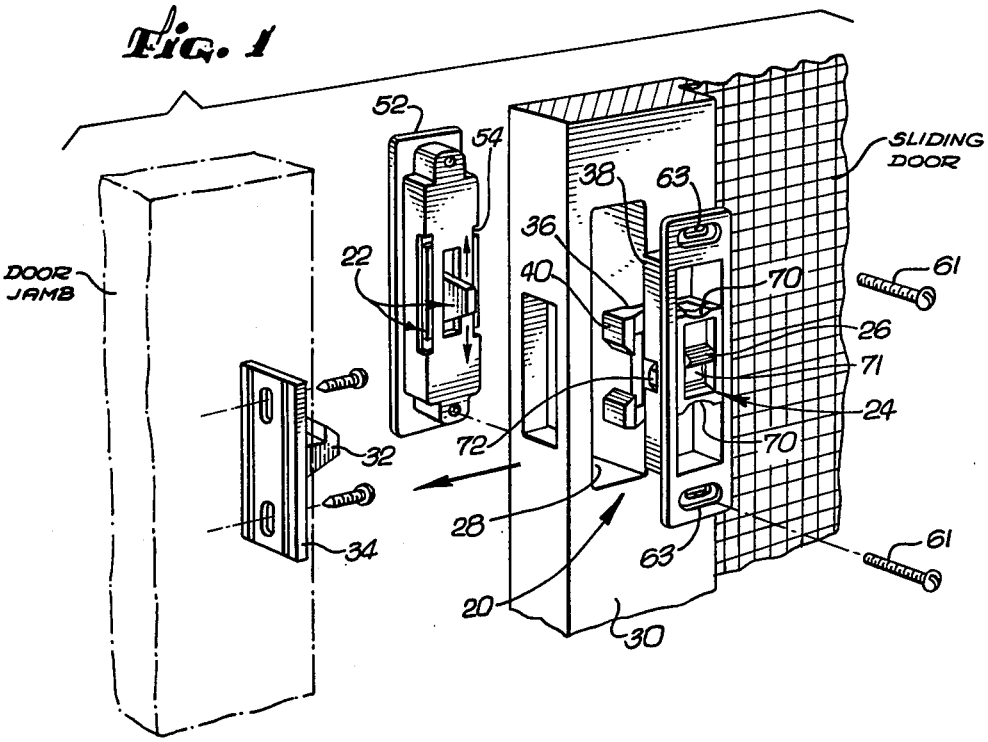
FIG. 1 is a partially exploded perspective view of a latching and locking mechanism in accordance with the present invention installed, in a sliding door and door jamb.
Figure 2:
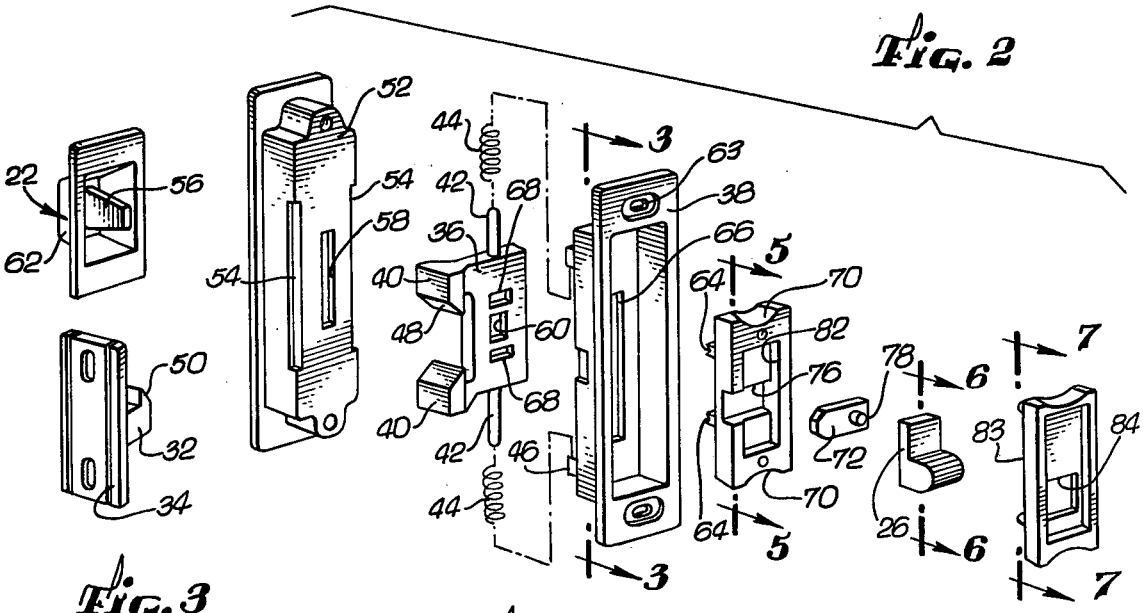
FIG. 2 is an enlarged and fully exploded perspective view of the mechanism of FIG. 1.
Figure 3:
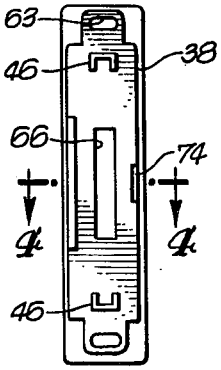
FIG. 3 is an elevational view of an inside housing of the latching and locking mechanism, taken generally along the line 3—3 of FIG. 2.
Figure 4:
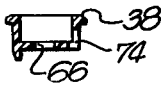
FIG. 4 is a cross sectional view of the inside housing taken generally along the line 4—4 of FIG. 3.
Figure 5:
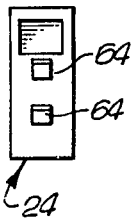
FIG. 5 is an elevational view of an inside slide member, taken generally along the line 5—5 of FIG. 2.
Figure 6:
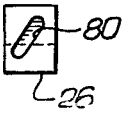
FIG. 6 is an elevational view of a bolt actuator of the latching and locking mechanism, taken generally along the line 6—6 of FIG. 2, showing an angular disposed cam slot.
Figure 7:
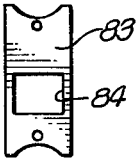
FIG. 7 is an elevational view of a slide cover of the latching and locking mechanism, taken generally along the line 7—7 of FIG. 2.

As is shown in the drawings for purposes of illustration, the present invention is embodied in a latching and locking mechanism, indicated generally by the numeral 20, for use with sliding doors such as patio screen doors, whereby unlatching may be accomplished by an outside slide member 22 or an inside slide member 24, and locking of the mechanism is accomplished from the inside of the sliding door by operation of a bolt actuator 26. The major part of the latching and locking mechanism 20 is mounted in a cavity 28 in a frame 30 of a sliding door, to allow engagement with a catch 32 on a keeper 34 mounted to the door jamb adjacent to the cavity 28.

In accordance with the present invention, a latch member 36 is slidably mounted to an inside housing 38 at a lengthwise central position thereof, so that one of a pair of latch hooks 40 on the latch member 36 may engage the catch 32 to latch the sliding door closed. The latch member 36 includes a pair of pins 42, one extending upwardly and the other downwardly from the generally rectangular body of the latch member 36, and a coil spring 44 is disposed over each pin 42. The latch member 36 is suspended at a lengthwise central position of the inside housing 38 by engagement of the pair of coil springs 44 with a pair of U-shaped tabs 46 on the inside housing 38, so that the latch member 36 is biased to a lengthwise central position in the absence of any applied external forces. Latching of the door is accomplished by sliding the door toward the door jamb so that an inclined surface 48 of the latch hook 40 slides upwardly against an inclined surface 50 of the catch 32, thereby forcing the latch member 36 to translate upwardly against the biasing force of the coil spring 44 and then allowing it to slide downwardly so that the latch hook 40 and the catch 32 are securely engaged, as illustrated in FIG. 8.

The outside slide member 22 and the inside slide member 24 are provided to translate the latch member 36 upwardly to disengage the latch hook 40 from the catch 32 so that the sliding door may be manually unlatched and opened. The outside slide member 22 is slidably mounted in an outside housing 52 by engagement with a pair of outside slide member retaining slots 54. A tang 56 extends inwardly from the outside slide member 22 through a tang slot 58 in the outside housing 52, to engage a tang receiving slot 60 in the rectangular portion of the latch member 36. By grasping the outside handle 62 and moving the outside slide member 22 upwardly, a person may manually translate the latch member 36 upwardly by forces transmitted through the tang 56 to the latch member 36, thereby clearing the latch hook 40 from the catch 32 so that the door may be slid open, as illustrated in FIG. 9.

In a similar fashion, an inside slide member 24 is slidably disposed in the inside housing 38, and a pair of lugs 64 extend through a lug slot 66 in the inside housing 38 to engage a pair of lug receiving slots 68 in the rectangular portion of the latch member 36, so that an upward sliding movement of the inside slide member 24 translates the latch member 36 upwardly to clear the latch hook 40 and the catch 32, again as illustrated in FIG. 9. Thus, the sliding door may be unlatched from the outside by grasping the outside handle 62 and sliding the outside slide member 22 upwardly, or unlatched from the inside by grasping a finger cutout 70 of the inside slide member 24 and moving the inside slide member 24 upwardly.

In the presently preferred embodiment of the invention, a locking mechanism 71 allows the latch member 36 to be locked in the central position by engaging a locking bolt 72 on the inside slide member 24 into a bolt opening 74 in the inside housing 38. The locking bolt 72 is disposed in a transverse slot 76 of the inside slide member 24, and includes a cam pin 78 extending outwardly from the locking bolt 72. A bolt actuator 26, having an angularly disposed cam slot 80 therein, is slidably mounted in a lengthwise slot 82 in the inside slide member 24. As illustrated in FIG. 10, the cam pin 78 of the locking bolt 72 engages the angularly disposed cam slot 80 of the bolt actuator 26 so that movement of the bolt actuator 26 relative to the inside slide member 24 along the lengthwise slot 82 cams the locking bolt 72 outwardly to protrude from the transverse slot 76 and engage the bolt opening 74, thereby locking the inside slide member 24 in position relative to the inside housing 38 and thence locking the latch member 36 at the lengthwise central position of the inside housing 38. With the latch member 36 so locked in position, neither the outside slide member 22 nor the inside slide member 24 may be operated to translate the latch member 36 to disengage the latch hook 40 from the catch 32, to allow unlatching and opening of the sliding door. A slide cover 83 covers and protects the locking bolt 72 and bolt actuator 26, with the handle of the bolt actuator 26 extending through an opening 84 of the slide cover 83 to allow operation of the locking mechanism 71.

To permit a single configuration of the latching and locking mechanism 20 to be utilized for doors opening from left to right and doors opening from right to left, the latching and locking mechanism 20 is constructed as lengthwise functionally symmetric. The term "lengthwise functionally symmetric" as used herein means that the portions of the latching and locking mechanism 20 mounted in the moving part of the sliding door may be inverted end for end and operated in an identical fashion in the inverted position. To accomplish this end, the latch member 36 is provided with the pair of symmetrical oppositely disposed pins 42 rather than a single pin, the pair of symmetrical oppositely disposed coil springs 44 rather than a single coil spring, and the pair of symmetrical oppositely disposed latch hooks 40 rather than a single latch hook. In the positioning of the latching and locking mechanism 20 illustrated in FIG. 1, only the upper pin 42, the upper coil spring 44, and the upper latch hook 40 are required for the latching and unlatching function, and unlatching is accomplished by moving the outside slide member 22 or the inside slide member 24 upwardly so that the sliding door may be opened from left to right. The identical mechanism illustrated may be utilized in a sliding door opening from right to left by inverting the latching and locking mechanism 20 and installing the latching and locking mechanism 20 in a fashion similar to that illustrated in FIG. 1. The keeper 34 is not inverted, but is mounted with the catch 32 extending upwardly on the door jamb of the right-to-left opening sliding door. Thereafter, the latching and locking mechanism 20 operates in a functionally identical manner to that described above. Although certain parts such as the bolt actuator 26 and the slide cover 82 are not constructed as fully lengthwise symmetric, this construction does not interfere with the functional operation of the latching and locking mechanism 20 in the inverted position, but only results in the locking function being accomplished by the downward movement by the bolt actuator 26 rather than upward movement.

To install the latching and locking mechanism 20 in a siding door, a cavity 28 in the frame 30 is first provided having sufficient size to receive the mechanism therein. The inside housing 38 with attached latch member 36, inside slide member 24 and the locking mechanism attached thereto is provided as a single assembled unit, and the outside housing 52 with attached outside slide member 22 is provided as a second assembled unit, as illustrated in FIG. 1. The two assemblies are inserted into the cavity 28 from the inner and outer sides of the door, with care taken that the tang 56 engages the tang receiving slot 60 in the latch member 36. The two assemblies are then joined by screws 61 or other fastening means substantially flush with the surfaces of the frame 30. The keeper 34 is attached to the door jamb 36 and positioned so that the latch hook 40 engages the catch 32 in the latched position. Slotted openings 63 for the fasteners may be provided in the inside housing 38 and the keeper 34 to allow minor adjustments so that the engagement is readily made.

The two preassembled assemblies provided by the manufacturer are constructed by first fabricating the individual parts of the latching and locking mechanism 20 from suitable materials, preferably plastic, except for the coil spring 44 fabricated from steel spring wire. The inside housing assembly is assembled by slipping the coil springs 44 over the pins 42 and compressing the coil springs 44 to allow engagement with the pair of U-shaped tabs 46 of the inside housing 38. The locking bolt 72 is placed in the transverse slot 76 of the inside slide member 24, and the bolt actuator 26 is placed in the lengthwise slot 82 of the inside slide member 24 so that the cam pin 78 engages the angularly disposed cam slot 80. The locking bolt 72 and the bolt actuator 26 are held in place by attachment of the slide cover 82 to the inside slide member 24. The inside slide member 24 is then placed within the inside housing 38 so that the lugs 64 extend through the lug slot 66 to engage the lug receiving slots 68, and the lugs 64 may be permanently bonded into the lug receiving slots 68 by gluing, so that the inside housing assembly cannot be separated during shipment and installation. The outside slide member 22 is assembled to the outside housing 52 by simply snapping the outside slide member 22 into the outside slide member retaining slot 54.

To avoid damage to the latching and locking mechanism 20 by the application of excessive opening forces during operation of the outside slide member 22 or the inside slide member 24, the slots 58 and 66 in the outside housing 52 and the inside housing 38 are dimensioned so that the slide members may be translated upwardly only sufficiently far to allow clearance of the latch hook 40 and the catch 32 during unlatching, as illustrated in FIG. 9. At that point, the outside slide member tang 56 or the inside slide member lugs 64 contact the top end of the associated slot to limit the extent of movement. Should excessive opening forces be applied to the outside slide member 22 or the inside slide member 24, the movement arm acting upon the tang 56 or the lugs 64 is sufficiently small such that the structure is capable of withstanding the forces without significant risk of breakage.

It will now be appreciated that, through the use of this invention, a sliding door may be latched and locked by a latching and locking mechanism 20 wherein the latch member 36 is translated to disengage the latch hook 40 from the catch 32 by an outside slide member 22 or an inside slide member 24. The latch member 36 may be locked in position by a locking mechanism comprising a locking bolt 72 and a bolt actuator 26 mounted on the inside slide member 24. The latching and locking mechanism 20 may be utilized either with doors opening from left to right or doors opening from right to left by simply inverting the mechanism, is economically manufactured, may be installed substantially flush with the surfaces of the sliding door, and absorbs excessive opening forces without transmitting those forces to inherently weaker portions of the structure.

Although a particular embodiment of the invention is described in detail for purposes of illustration, various embodiments may be made without departing from the spirit and scope of the invention. Accordingly, the invention is not to be limited except as by the appended claims.

I claim:

1. A latching and locking mechanism for use with a sliding door, the door being supported in a frame having a jamb, the jamb having a keeper mounted thereon, comprising:

latch means for releasable locking engagement with the keeper mounted in the door jamb of the sliding door, said latch means being mounted in the sliding door;

slide means operable from either side of the door for operating said mechanism to disengage said latch means from the keeper; and locking means for disabling movement of said latch means to prevent disengagement of said latch means from the keeper, said locking means being operable from only one side of the door.

2. The mechanism of claim 1, wherein said locking means comprises a locking bolt engageable to prevent movement of said slide means.

3. The mechanism of claim 1, wherein the latching and locking mechanism is lengthwise functionally symmetric, so that the assembly may be used in doors which open from left to right and doors which open from right to left by inverting the assembly.

4. The mechanism of claim 1, wherein said latch means comprises:

a latch member slidably translatable by said slide means, said latch member having a latch hook for engaging a catch on the keeper; and biasing means for urging said latch hook toward a position of engagement with the catch on the keeper.

5. The mechanism of claim 1, wherein said slide means comprises:

an outside slide member for slidably disengaging said latch means from the keeper, said outside slide member being operable only from the outside of the door; and an inside slide member for slidably disengaging said latch means from the keeper, said inside member being operable only from the inside of the door.

6. The mechanism of claim 5, further comprising housing means for mounting said outside slide member, said inside slide member, said latch means and said locking means.

7. A latching and locking mechanism for use with a sliding door, comprising:

latch means for releasable locking engagement with a keeper mounted in the door jamb;

slide means for disengaging said latch means from the keeper, said slide means comprising:

an outside slide member for slidably disengaging said latch means from the keeper, said outside slide member being operable only from the outside of the door; and an inside slide member for slidably disengaging said latch means from the keeper, said inside member being operable only from the inside of the door;

locking means for disabling movement of said latch means to prevent disengagement of said latch means from the keeper, said locking means being operable from only one side of the door, and wherein said locking means comprises a locking bolt mounted on said inside slide member, and a bolt actuator operable to move said locking bolt into engagement with a bolt opening in said housing means to prevent movement of said inside slide member to disengage said latch means from the keeper; and housing means for mounting said outside slide member, said inside slide member and said locking means.

8. A mechanism for latching and locking a sliding door to a door jamb, comprising:

keeper means mounted on the door jamb, said keeper means including a catch;

latch means on the sliding door for engaging the catch, to prevent the sliding door from being opened;

an outside slide member operable from the outside of the sliding door to disengage said latch means from the catch;

inside slide member operable from the inside of the sliding door to disengage said latch means from the catch;

locking means for preventing the disengagement of said latch means from the catch, said locking means being operable only from the inside of the sliding door; and housing means for mounting said latch means, said outside slide member, said inside slide member and said locking means in a cavity of the sliding door.

9. A mechanism for latching and locking a sliding door to a door jamb, comprising:

keeper means mounted on the door jamb, said keeper means including a catch;

latch means on the sliding door for engaging the catch, to prevent the sliding door from being opened;

an outside slide member operable from the outside of the sliding door to disengage said latch means from the catch;

an inside slide member operable from the inside of the sliding door to disengage said latch means from the catch;

locking means for preventing the disengagement of said latch means from the catch, said locking means being mounted on said inside slide member and being operable only from the inside of the sliding door; and housing means for mounting said latch means, said outside slide member, said inside slide member and said locking means in a cavity of the sliding door.

10. The mechanism of claim 9, wherein said locking means comprises:

a locking bolt slidably disposed in a transverse slot of said inside slide member so that said locking bolt may be extended to engage a bolt opening formed in said housing, thereby preventing movement of said inside slide member, said locking bolt having a cam pin thereon;

a bolt actuator slidably disposed in a lengthwise slot of said inside slide member, said bolt actuator having an angularly disposed cam slot therein, said cam slot engaging said cam pin so that movement of said bolt actuator in one direction relative to said inside slide member extends said locking bolt to engage the bolt opening of said housing means, and movement of said bolt actuator in an opposite direction relative to said inside slide member retracts said locking bolt from the bolt opening in said housing means.

11. A mechanism for latching and locking a sliding door to a door jamb, comprising:

keeper means mounted on the door jamb, said keeper means including a catch;

latch means on the sliding door for engaging the catch, to prevent the sliding door from being opened;

an outside slide member operable from the outside of the sliding door to disengage said latch means from the catch;

an inside slide member operable from the inside of the sliding door to disengage said latch means from the catch;

locking means for preventing the disengagement of said latch means from the catch, said locking means being operable only from the inside of the sliding door; and housing means for mounting said latch means, said outside slide member, said inside slide member and said locking means in a cavity of the sliding door, wherein said latch means, said outside slide member, said inside slide member, said locking means and said housing means are functionally symmetric from top to bottom so that said mechansim may be used with sliding doors which open from left to right and sliding doors which open from right to left by inverting the portion of said mechanism mounted in the sliding door.

12. A mechanism for latching and locking a sliding door to a door jamb, comprising:

keeper means mounted on the door jamb, said keeper means including a catch;

latch means on the sliding door for engaging the catch, to prevent the sliding door from being opened, wherein said latch means comprises:

a latch member, said latch member having two top-to-bottom symmetric latch hooks thereon; and biasing means for urging said latch member into a lengthwise central position within said housing means;

an outside slide member operable from the outside of the sliding door to disengage said latch means from the catch;

an inside slide member operable from the inside of the sliding door to disengage said latch means from the catch;

locking means for preventing the disengagement of said latch means from the catch, said locking means being operable only from the inside of the sliding door; and housing means for mounting said latch means, said outside slide member, said inside slide member and said locking means in a cavity of the sliding door.

13. A latching and locking mechanism for use with a sliding door, comprising:

a keeper mounted to the door jamb, said keeper having a catch thereon;

a housing adjustably mounted in the sliding door;

a latch member having two opposing latch hooks thereon mounted in said housing, said latch member being biased into a lengthwise central position in said housing so that one of the latch hooks may engage the catch on said keeper when said latch member is in the lengthwise central position;

an outside slide member slidably mounted in said housing on the outside facing side of the sliding door, said outside slide member having a tang extending therefrom to engage a tang receiving slot in said latch member so that upward sliding movement of said outside slide member causes upward translation of said latch member, thereby disengaging the latch hook from the catch on said keeper so that the sliding door may be opened;

an inside slide member slidably mounted in said housing on the inward facing side of the sliding door, said inside slide member having at least one lug extending therefrom to engage a lug receiving slot in said latch member so that upward sliding movement of said inside slide member causes upward translation of said latch member, thereby disengaging the latch hook from the catch on said keeper so that the sliding door may be opened; and a locking mechanism mounted on said inside slide member whereby movement of said latch member is prevented when said locking mechanism is activated.

14. The mechanism of claim 13, wherein said locking mechanism comprises:

a locking bolt slidably disposed in a transverse slot in said inside slide member so that said locking bolt may be extended to engage a bolt opening in said housing to lock said inside slide member in place, thereby locking said sliding door by preventing disengagement of the latch member from the catch on said keeper, said locking bolt having a cam pin extending therefrom; and a bolt actuator slidably disposed in a lengthwise slot in said inside slide member, said bolt actuator having an angularly disposed cam slot therein for engaging the cam pin on said locking bolt, so that movement of said bolt actuator in said lengthwise slot displaces said locking bolt by a camming action into and out of engagement with the bolt opening.

15. A latching and locking mechanism for use with a sliding door, comprising:

an outside housing member;

an outside slide member slidably carried by said outside housing member;

an inside housing member;

an inside slide member slidably carried by said inside housing member;

latch means for releasable latching engagement with a keeper mounted on a door jamb;

means for mounting said outside and inside housing members with respect to the door, said outside and inside slide members each having means thereon for operatively engaging said latch means when said outside and inside housing members are mounted with respect to the door such that sliding movement of one of said outside and inside slide members is operable to unlatch said latch means from the keeper; and means for locking said inside slide member from sliding movement with respect to said inside housing member to lock said latch means against disengagement from the keeper.

16. A latching and locking mechanism for use with a sliding door, comprising:

an outside housing member;

an outside slide member slidably carried by said outside housing member;

an inside housing member;

an inside slide member slidably carried by said inside housing member;

latch means for releasable latching engagement with a keeper mounted on a door jamb;

means for mounting said outside and inside housing members with respect to the door, said outside and inside slide members each having means thereon for operatively engaging said latch means when said outside and inside housing members are mounted with respect to the door such that sliding movement of one of said outside and inside slide members is operable to unlatch said latch means from the keeper; and means for locking said inside slide members from sliding movement with respect to said inside housing member to lock said latch means against disengagement from the keeper, wherein said locking means comprises a locking bolt carried by said inside slide member for sliding movement between a locked position projecting into a bolt opening formed in said inside housing member and an unlocked position retracted from said bolt opening.

17. The mechanism of claim 16 wherein said locking bolt has a cam pin projecting outwardly therefrom, and including a bolt actuator slidably carried by said inside slide member for movement between first and second positions, said bolt actuator having a cam slot formed therein for reception of said cam pin such that movement of said bolt actuator between said first and second positions correspondingly moves said locking bolt between the locked and unlocked positions.

18. A latching and locking mechanism for use with a sliding door, comprising:

an outside housing member;

an outside slide member slidably carried by said outside housing member;

an inside housing member;

an inside slide member slidably carried by said inside housing member;

latch means for releasable latching engagement with a keeper mounted on a door jamb;

means for retaining said latch means between said outside and inside housing members and in a normal position for locking engagement with the keeper means for mounting said outside and inside housing members with respect to the door, said outside and inside slide members each having means thereon for operatively engaging said latch means when said outside and inside housing members are mounted with respect to the door such that sliding movement of one of said outside and inside slide members is operable to unlatch said latch means from the keeper; and means for locking said inside slide member from sliding movement with respect to said inside housing member to lock said latch means against disengagement from the keeper.

* * * * *